United States Patent [19]

Suekane

[11] Patent Number: 4,793,563

[45] Date of Patent: Dec. 27, 1988

[54] WIRE HOLDING DEVICE FOR COIL WINDING MACHINE HAVING WIRE CHIP REMOVING MECHANISM

[75] Inventor: Yoji Suekane, Tokyo, Japan

[73] Assignee: Tanaka Seiki Co., Ltd., Tokyo, Japan

[21] Appl. No.: 27,446

[22] Filed: Mar. 18, 1987

[30] Foreign Application Priority Data

Apr. 1, 1986 [JP] Japan ..... 61-48433[U]

[51] Int. Cl.[4] ..... B21F 3/00

[52] U.S. Cl. ..... 242/1; 242/7.01; 242/7.06; 15/256.5

[58] Field of Search ..... 242/7.06, 7.17, 7.18, 242/7.03, 1; 29/403.1; 15/256.5

[56] References Cited

U.S. PATENT DOCUMENTS 4,470,552 9/1984 Parham et al. ..... 242/7.09 X

OTHER PUBLICATIONS

Western Electric Technical Dig. No. 37, "Terminal Insertion Apparatus for Wire Spring Relay", P. L. Phillips, 1/1975.

*Primary Examiner*—Stanley N. Gilreath
*Assistant Examiner*—Katherine Matecki
*Attorney, Agent, or Firm*—Spencer & Frank

[57] ABSTRACT

A wire holding device for a coil winding machine having a wire chip removing mechanism. A wire holding support is mounted rotatably on a movable base and has wire holders each having fingers, which may be opened and closed for wire holding and releasing operations. The wire holder support is rotated for 180° from the wire holding position with closed fingers to the releasing position, where the fingers are opened to drop any wire chips put therebetween. At the returning movement of the support to the wire holding position by a ½° rotation, the support moves touching elastic soft wire chip removers to completely wipe out the wire chips.

4 Claims, 4 Drawing Sheets

WIRE HOLDING DEVICE FOR COIL WINDING MACHINE HAVING WIRE CHIP REMOVING MECHANISM

BACKGROUND OF THE INVENTION

The present invention relates to a wire holding device for a coil winding machine used to hold wire of a coil to be wound around a bobbin or to cut the wire by suddenly moving the wire while the wire is held by the holder. And more particularly, it relates to a wire holding device containing a chip removing mechanism suitable for a coil winding machine using an extremely thin wire.

Wire holding devices for coil winding machines are known, which can cut wire by at first putting or winding it on a terminal pin mounted on a coil bobbin of the coil winding machine, then holding the wire by a wire holder and by suddenly moving the wire holder.

Recently small sized coils have been used, and extremely thin wire has also been used. Wire chips made when cutting such thin wire are very light-weight and are apt to stick to the finger portions of the wire holding device due to the electrification of the wire holding device or in the coatings of wires. These wire chips might enter into a bobbin or coil windings in the next coil winding operation and might cause a short-circuit in the coil windings and other damages. These surely result in the degradation of the reliability of the final products.

An object of the present invention is therefore to provide a wire holding device, in which wire chips which stick to the fingers which hold the wire may be removed each time at the completion of one wire holding operation for coil winding, so that highly reliable products may be obtained.

SUMMARY OF THE INVENTION

A wire holding device according to the present invention has a wire chip removing mechanism, and comprises a moving base; a wire holder support rotatably mounted about an axle bar forming an axis of rotation, the axle bar being supported on a support arm mounted on the moving base; wire holders mounted on the wire holder support and each having fingers driven by actuators; a rotary actuator mounted on the moving base and driving to rotate the wire holder support between its wire holding position of the fingers and the wire releasing position; wire chip removers in the form of plates made of a soft elastic material, such as polyurethane, the wire holders being slidingly movable between the wire chip removers during the return from the releasing position to the wire holding position of the wire holder support; a wire chip remover support movably supporting the wire chip removers; and another actuator fixed to the moving base and driving the wire chip remover support in the forward and retreating direction. Further, an air cylinder is provided, which is disposed in a selected position, so that when the center of mass of the rotated wire holders and the wire holder support is rotated and raised against the force of gravity, the expanding force of the air cylinder is exerted on the wire holders and wire holder support in addition to the rotational force of the rotary actuator in the same direction of its rotation, and when the center of mass thereof is lowered, the air cylinder is compressed by the rotational force of the rotary actuator.

BRIEF EXPLANATION OF THE DRAWINGS

FIG. 1(*b*) is a front view of the embodiment shown in FIG. 1(*a*), showing the state when a wire holder supporting stand is positioned at the side of a wire chip remover support.

FIG. 2(*b*) is a front view of the embodiment shown in FIG. 2(*a*).

DESCRIPTION OF THE PREFERRED EMBODIMENT

Figure 1A:
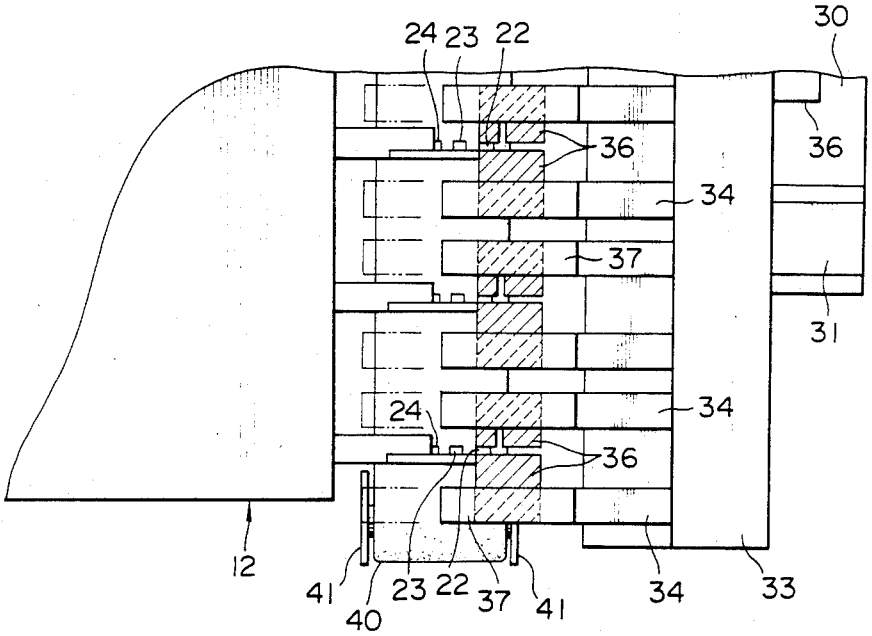
FIG. 1(*a*) is a plan view showing a principal portion of an embodiment of the wire holding device for a coil winding machine according to the present invention.

In the figures, a moving base 1 is movable in the axial direction of a coil winding machine, not shown, or in the crossing direction with respect to the axle of a spindle mounted on a base fixed to the coil winding machine. The moving base 1 is supported by a pair of guide bars 2, which are guided in the parallel direction with respect to the spindle, and the moving base 1 is movable by a plurality of actuators, not shown, in a plane in the longitudinal and transverse directions with respect to the winding position in the coil winding machine.

To the moving base 1 is fixed a support arm 3, and on one end of the support arm 3 is mounted an axle bar 4, which rotatably supports a wire holder support 12.

Figure 2A:
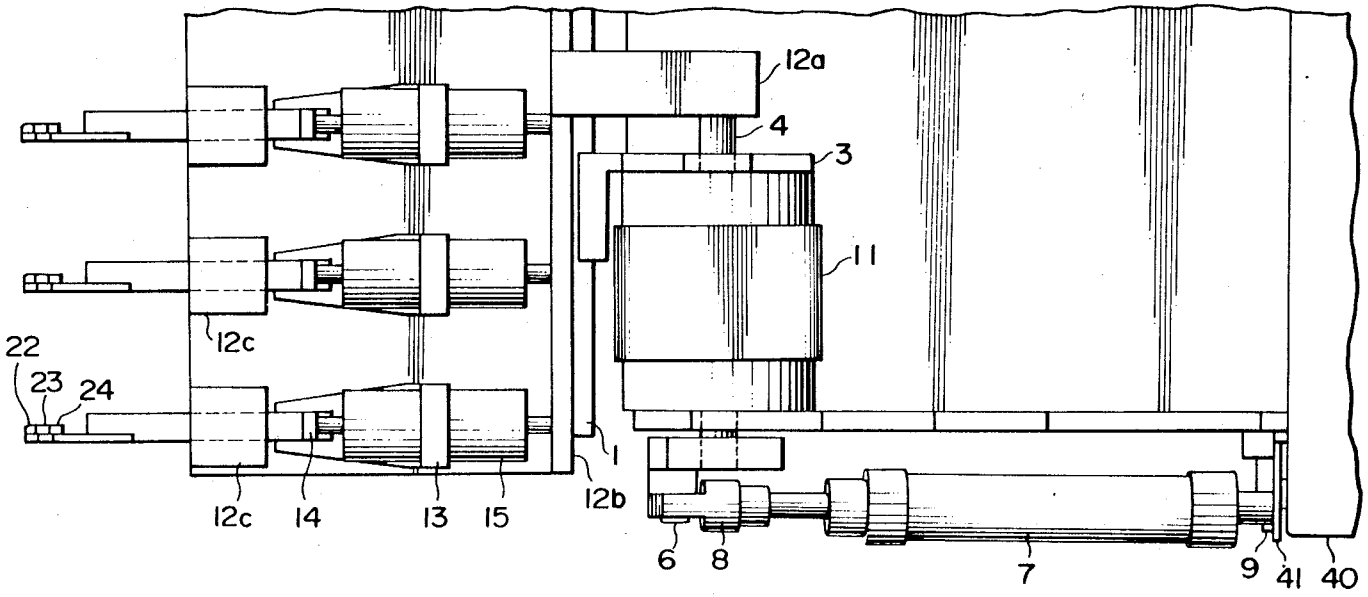
FIG. 2(*a*) is a plan view of a portion of the emobdiment shown in FIG. 1(*a*), showing a state of the wire holder support being at the side of a spindle of a coil winding machine, not shown.
Figure 2B:
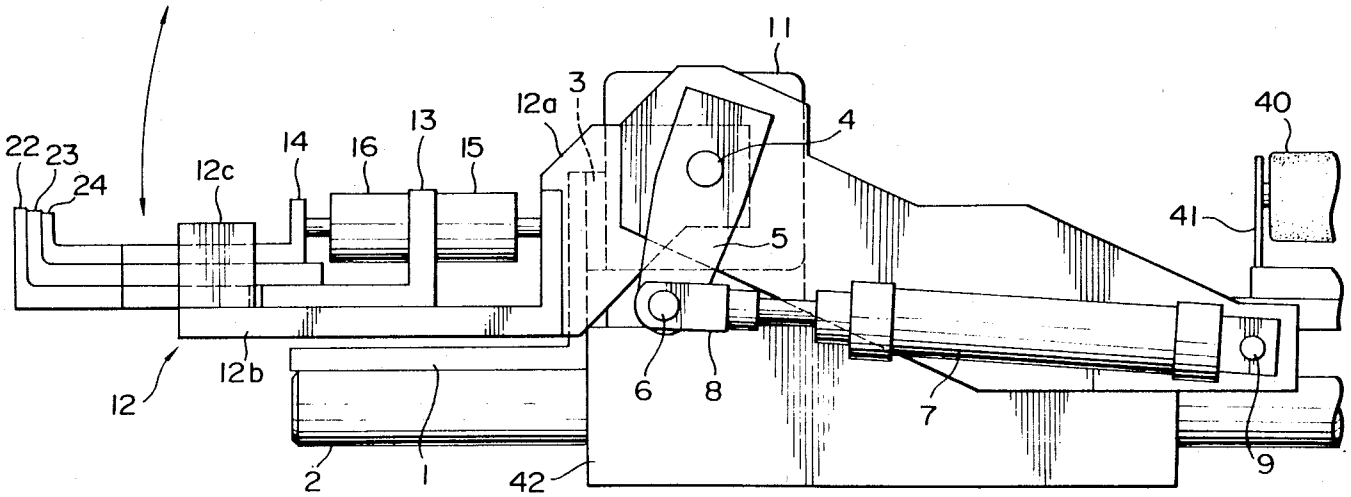

As shown in FIGS. 2(*a*) and 2(*b*), the moving portion of a rotary actuator 11 is fixed on the axle bar 4, while the actuator 11 is fixed to the moving base 1, thus a rotating force is given to rotate the wire holder support 12.

A connection lever 5 is fixed on the axle bar 4 and a free end of the lever 5 is connected with a moving portion 8 of an air cylinder 7 by means of hinge mechanism 6.

Figure 1B:
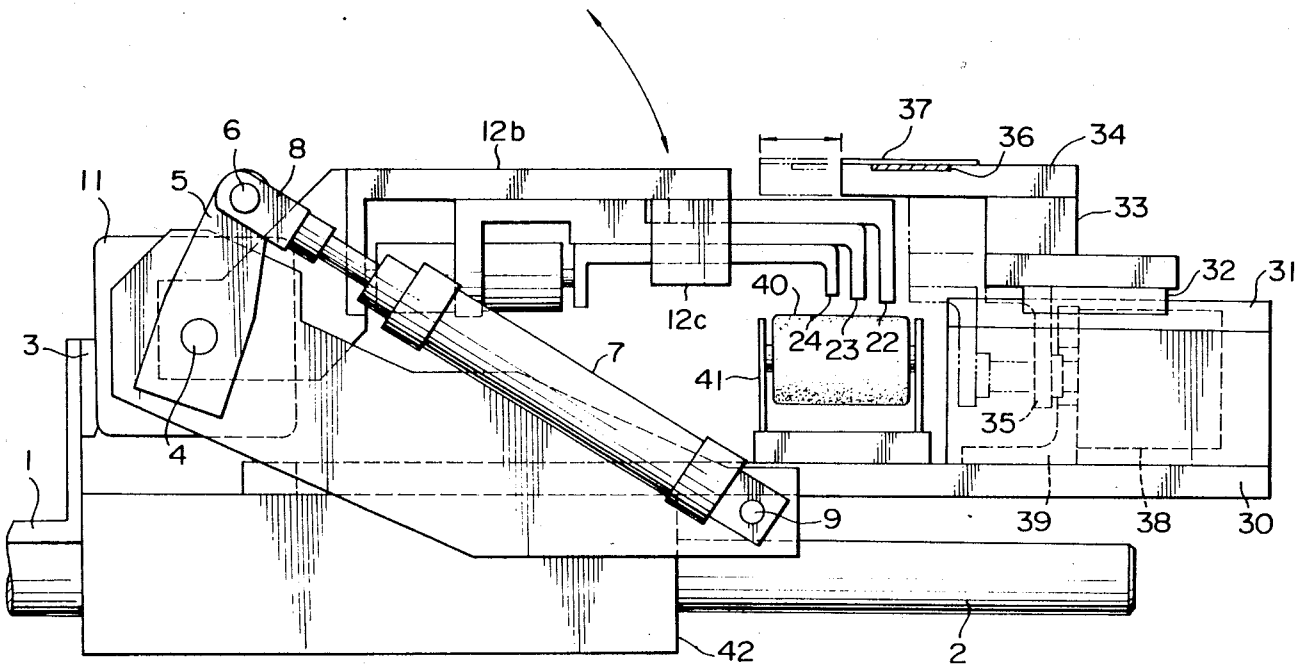

When the wire holder support 12 supporting a plurality of wire holders is rotated through an angle of 180° by the rotary actuator 11 and moves from the state of FIG. 2(i b) to the state of FIG. 1(*b*) in the clockwise direction of the figures, the wire holder support 12 is rotated through the first 90 degrees, and the center of mass of the wire holders and the wire holder support 12 is moved to the higher position, i.e. is moved upwardly against the force of gravity. For this reason, a stronger rotating force is required. In the machine of the present invention, the moving portion 8 of the air cylinder 7 is elongated by the expansion force of air already compressed within the air cylinder 7, with which the axle bar 4 is actuated in the clockwise direction (in the figures) through the hinge mechanism 6 and the connection lever 5, to increase the rotating force of the rotary actuator 11.

On the other hand, when the wire holder support 12 finishes the first half of the clockwise rotation, the center of mass of the wire holders and the wire holder support 12 moves to a lower position, i.e. is moved downwardly aided by the force of gravity. At this state, a rotation torque is not required, or rather it is required to give some rotation force in the anti-clockwise direction of the figures in order to slow down the wire holder support 12 and not to give a strong shock to the part at the completion of the rotation. In order to avoid this objectionable phenomena, the air cylinder 7 is compressed during the later half of the rotation of the wire holder support 12, so that the expanding force of the air compressed by the rotation of the wire holder support 12 within the cylinder 7 actuates the axle bar 4 in the anti-clockwise direction of the figures. The position of a supporting axle 9 of the air cylinder 7 is determined and mounted thereto.

As shown in FIGS. 2(*a*) and 2(*b*), the wire holder support 12 consists of a support base 12*a* fixed on the axle bar 4, a support plate 12*b* fixed to the support base 12*a*, and finger guides 12*c* respectively fixed to the support plate 12*b*.

In the present embodiment of the coil winding machine, a finger portion consisting of three fingers are provided to hold wire, and one fixed finger 22 thereof is fixed at a forward end of the support plate 12*b* of the wire holder support 12 and also to the lower part of a finger guide 12*c*.

Two other fingers 23 and 24 are movable and extend through the inner portion of the finger guide 12*c*. These fingers are movable towards and away from fixed finger 22 as shown in the figures.

A first movable finger 23 is mounted on a first movable finger base 13, which is made movable on the support plate 12*b* towards and away from fixed finger 22. Another finger, a second movable finger 24 is mounted to a second movable finger base 14 and is movable on the first movable finger 23 towards and away from the fixed finger 22.

The first movable finger base 13 is L-shaped and at both sides of its upright portion are fixed air cylinders 15 and 16, respectively.

The air cylinder 15 faces an upright portion of the support plate 12*b*. By the elongation of the moving portion of the air cylinder 15, it pushes the facing upright portion of the plate 12*b*, to move the first movable finger 23 towards and against the fixed finger 22. If a lead is positioned between the fingers 22 and 23, it may be held therebetween.

The air cylinder 16 faces the upright portion of the second movable finger base 14. When the moving portion of the cylinder 16 is elongated, it pushes the upright portion of the second movable finger base 14 and fits the fingers 23 and 24 with each other. If a wire is positioned between the fingers 23 and 24, it may be caught and held therebetween.

The mechanism and operation of the wire chip remover will now be explained with reference to FIGS. 1(*a*) and 1(*b*).

As shown in FIG. 1(*b*), on a fixed base 42 is fixed a wire chip treating plate 30, and on the wire chip treating plate 30 are fixed a belt conveyor mounting stand 41 and a guide rail 31.

A belt conveyor 40 is mounted to the belt conveyor mounting stand 41 through rollers, and a wire chip remover support 33 is mounted to the guide rail 31 through a guide rail receiver 32. The support 33 is horizontally movable from right and left in the figures.

To the wire chip remover support 33 are fixed wire chip remover mounting plates 34 and a wire chip remover driving plate 35.

Three pairs of the wire chip remover mounting plates 34 are provided in the positions respectively putting the fingers, each consisting of the fixed finger and first and second movable fingers, therebetween by leaving appropriate space between the plates 34 of the respective pairs as shown in FIG. 1(*a*). The upper portion of each of the plates 34 is provided with a recess in which wire chip removers 36, in the form of plates made of a soft elastic material such as polyurethane, are positioned. Wire chip remover press plates 37 are fixed on the plates 36.

An air cylinder 38 is mounted to the wire chip treating plate 30 through an air cylinder mounting plate 39. By the elongation of the moving portion of the air cylinder 38, the driving plate 35 is moved horizontally toward the conveyor 40 and accordingly the wire chip remover mounting plate 34 may be moved to a position shown in two-dotted chain line in the figure.

Before the coil winding operation, a wire holder holds the wire to be wounded around a bobbin for a while. On the other hand, after the wire has been wound on a bobbin the wire holder, while holding the wire, is suddenly moved to cut the wire. These operations are carried out when the wire holders are at the position of FIGS. 2(*a*) and 2(*b*). After the completion of the coil winding and these series of operations, the wire holder support 12 is driven by the rotary actuator 11 and the air cylinder 7, and accordingly the three fingers together with the support 12 rotate in the clockwise direction (of the figure) for 180° from the state of FIGS. 2(*a*) and 2(*b*) to that of FIGS. 1(*a*) and 1(*b*), while the fingers are closed.

At the completion of the clockwise rotation (of the figure) of the support 12, it opens the three fingers and drops any wire chips put between the fixed finger 22 and the first movable finger 23 and between the first movable finger 23 and the second movable finger 24 onto the belt conveyor 40. FIGS. 1(*a*) and 1(*b*) show this state.

While opening the three fingers, the air cylinder 38 is driven to move the wire chip remover support 33 until it moves the wire chip remover mounting plates 34 to the positions shown in two-dotted chain line in the figure.

By this movement, the wire chip remover 36 reaches the position over the opened three fingers, and when the support 12 rotates in the anti-clockwise direction of the figure to return to the state of FIGS. 2(*a*) and 2(*b*), the end portions of the three fingers move slidingly between the wire chip remover 36, 36.

Thus the fingers moves reciprocally and slide while touching the wire chip remover 36, 36 after completion of a series of coil winding operation, all the waste including the wire chips attached between the fingers are dropped onto the belt conveyor 40, and received into a wire chip receiver, not shown, provided near an end of the belt conveyor 40.

As is shown in FIGS. 1(*a*) and 1(*b*), each of the wire chip removers 36 extends from a wire chip remover press plate 37, so that the extensions of the removers 36 extending from the press plates 37 put the passage of the fingers therebetween. In the embodiment shown, the length of the extensions for a group of fingers is different from each other and further a slit is provided for each of the shorter extensions of the removers 36. These forms of the extensions are chosen based on the repeated experiments carefully considering the shape of the fingers which pass between the extensions, the positions thereof where the wire chips may be sticked to, the passing velocity of the fingers, etc., so that the extension may well touch the sides of the fingers, thus providing an efficient cleaning of the wire chips.

Modifications and improvements may be made on the embodiment shown in the figures and within the scope of the Claims of the present invention.

Instead of the three fingers, two or four, or more fingers may be used. Fewer or more wire holders than those of the shown holders may be used. Also, the air cylinders used may be replaced with other type of actuators.

As fully explained in detail, according to the present invention, the wire holders are rotated for 180°, and the wire chip removers made of soft elastic plates are disposed to put therebetween the passing passage where the fingers pass at the time of rotation. Thus any wire chips put between or stuck to the fingers may be dropped or removed in the wire holding operation before and after the coil winding operation. From this structure, it is particularly advantageous when the extremely thin wire is used, because the wire chips of this inner wire may easily stick to the wire holders, which might be mixed into the next coils in the next coil winding operation and generate a cause for damage of such a coil.

What is claimed is:

1. A wire holding device for a coil winding machine having a wire chip removing mechanism, said device comprising;

a moving base;

a support arm mounted on said moving base;

an axle bar supported by said support arm;

a wire holder support rotatably mounted on said axle bar with said axle bar forming an axis of roatation;

a wire holder mounted on said wire holder support, said wire holder having a plurality of fingers driven by first actuators;

a rotary actuator mounted on said moving base for rotating said wire holder support about said axle bar from a first wire holding position to a second wire releasing position; and a wire chip remover selectively positioned adjacent said wire holder when said wire holder is in said second wire releasing position for removing wire from said fingers;

wherein said plurality of fingers slidingly engage said wire chip remover during a return of said wire holder support from said second wire releasing position to said first wire holding position.

2. A wire holding device for a coil winding machine having a wire chip removing mechanism according to claim 1, further comprising a wire chip remover support movably supporting said wire chip remover; and a second actuator fixed to said moving base which drives said wire chip remover support in forward and retreating directions.

3. A wire holding device for a coil winding machine having a wire chip removing mechanism according to claim 2, further comprising an air cylinder, said air cylinder being disposed in a selected position, such that when the center of the mass of said wire holder and said wire holder support is rotated against the force of gravity, an expanding force of said air cylinder is exerted to the rotational force of the rotary actuator in the same direction of the rotation of said wire holder and said wire holder support, and when the center of mass thereof is lowered with the force of gravity, said air cylinder is compressed by the rotational force of said rotary actuator.

4. A wire holding device for a coil winding machine having a wire chip removing mechanism according to claim 3, further comprising a belt conveyor provided at the second wire releasing position of the fingers of the wire holder onto which wire chips stuck thereto or put therebetween are dropped.

* * * * *